US006772820B2

(12) United States Patent
Roze et al.

(10) Patent No.: US 6,772,820 B2
(45) Date of Patent: Aug. 10, 2004

(54) POLYURETHANE BASED BINDER SYSTEM FOR THE MANUFACTURE OF FOUNDRY CORES AND MOLDS

(75) Inventors: Jean-Claude Roze, Gaillon (FR); Günther Weicker, Solingen (DE); Diether Koch, Mettmann (DE); Andreas Werner, Dusseldorf (DE)

(73) Assignee: Ashland Inc., Dublin, OH (US)

( * ) Notice: Subject to any disclaimer, the term of this patent is extended or adjusted under 35 U.S.C. 154(b) by 0 days.

(21) Appl. No.: 10/603,673

(22) Filed: Jun. 26, 2003

(65) Prior Publication Data

US 2004/0006155 A1 Jan. 8, 2004

Related U.S. Application Data

(63) Continuation of application No. 09/806,864, filed as application No. PCT/EP99/08419 on Nov. 4, 1999, now abandoned.

(30) Foreign Application Priority Data

Nov. 4, 1998 (DE) ..... 198 50 833

(51) Int. Cl.[7] ..... B22C 1/22

(52) U.S. Cl. ..... 164/16; 164/526; 523/139; 523/145

(58) Field of Search ..... 164/456, 12, 16, 164/21, 526; 523/139, 145; 528/86

(56) References Cited

U.S. PATENT DOCUMENTS

| | | | | | |
|---|---|---|---|---|---|
| 4,546,124 | A | * | 10/1985 | Laitar et al. | 523/143 |
| 4,657,950 | A | * | 4/1987 | Iyer et al. | 523/145 |
| 4,848,442 | A | * | 7/1989 | Iyer et al. | 164/526 |
| 4,852,629 | A | * | 8/1989 | Fechter et al. | 164/16 |
| 5,101,001 | A | * | 3/1992 | Henry et al. | 528/139 |
| 5,516,859 | A | * | 5/1996 | Dunnavant et al. | 525/504 |
| 5,874,487 | A | * | 2/1999 | Singh et al. | 523/143 |
| 5,908,914 | A | * | 6/1999 | Dando et al. | 528/129 |

FOREIGN PATENT DOCUMENTS

| | | | | |
|---|---|---|---|---|
| EP | 771 599 A1 | * | 5/1997 | B22C/1/22 |
| WO | WO 95/14736 | * | 6/1995 | C08K/5/51 |
| WO | WO 98/02473 | * | 1/1998 | C08G/8/10 |

* cited by examiner

*Primary Examiner*—Kiley Stoner
*Assistant Examiner*—Kevin P. Kerns
(74) *Attorney, Agent, or Firm*—David L. Hedden

(57) ABSTRACT

A cold-box process for preparing a foundry shape, e.g. mold or core, that uses a binder comprising a phenolic resin component and an isocyanate component, wherein the phenolic resin component comprises (a) an alkoxy-modified phenolic resole resin and (b) an oxygen-rich polar, organic solvent component, which contains a fatty acid ester.

5 Claims, No Drawings

POLYURETHANE BASED BINDER SYSTEM FOR THE MANUFACTURE OF FOUNDRY CORES AND MOLDS

This application is a continuation application of U.S application Ser. No. 09/806,864 filed on Jul. 9, 2001, now abandoned which is a 371 of PCT/EP99/08419 filed on Nov. 4, 1999, DE 198 50 833 filed on Nov. 4, 1998, U.S. application Ser. No. 9/806,864 filed on Jul. 9, 2001.

FIELD OF THE INVENTION

This invention relates to a binder system comprising a phenolic resin component and an isocyanate component, wherein the phenolic resin component comprises (a) an alkoxy-modified phenolic resole resin and (b) an oxygen-rich polar, organic solvent.

BACKGROUND OF THE INVENTION

A well-known and commercially successful method for preparing foundry cores and molds is the "Cold-Box-Process" or the "Ashland-Process". According to this method, a two-component polyurethane binder system is used for the bonding of sand. The first component consists of a solution of a polyol, which contains at least two OH groups per molecule. The second component is a solution of an isocyanate having at least two NCO groups per molecule. The curing of the binder system takes place in the presence of a basic catalyst. Liquid bases can be added to the binder system before the molding stage, in order to bring the two components to reaction (U.S. Pat. No. 3,676,392). Another possibility, according to U.S. Pat. No. 3,409,579, is to pass gaseous tertiary amines through a shaped mixture of an aggregate and the binder.

In both these patents, phenolic resins are used as polyols, which are prepared through condensation of phenol with aldehydes, preferably formaldehyde, in the liquid phase, at temperatures of up to around 130° C., in the presence of divalent metal catalysts. The manufacture of such phenolic resins is described in detail in U.S. Pat. No. 3,485,797. In addition to unsubstituted phenol, substituted phenols, especially o-cresol and p-nonyl phenol, can be used (for example, EP-A-183 782).

As additional reaction components, according to EP-B-0 177 871, aliphatic monoalcohols with one to eight carbon atoms can be used to prepare alkoxylated phenolic resins. According to this patent, the use of alkoxylated phenolic resins in the binder results in binders that have a higher thermal stability.

As solvents for the phenolic components, mixtures of high-boiling point polar solvents (for example, esters and ketones) and high boiling point aromatic hydrocarbons are typically used. The polyisocyanates, on the other hand, are preferably dissolved in high boiling point aromatic hydrocarbons. In European Patent application EP-A-0 771 599, formulations are described, which eliminate or reduce the amount of aromatic solvents, as a result of the use of fatty acid methyl esters. The fatty acid methyl esters are used either as stand-alone solvents or with the addition of polarity-raising solvents (phenolic-components), or, as the case may be, aromatic solvents (isocyanate components). Cores manufactured with this binder system are particularly easy to remove from the mold tooling.

In practice, however, binder systems formulated according to EP-A-0 771 599, display a serious disadvantage. They produce smoke during the casting process, so much that in many foundries, they are not practical to use.

In order to comply with the increasingly higher environmental standards and health and safety requirements, there has for many years been a growing interest in binder systems which contain no, or very little aromatic hydrocarbon solvent, but produce cores with adequate tensile properties.

SUMMARY OF THE INVENTION

This invention relates to a binder system comprising a phenolic resin component and an isocyanate component, wherein the phenolic resin component comprises (a) an alkoxy-modified phenolic resole resin and (b) an oxygen-rich polar, organic solvent. The invention also relates to foundry mixes prepared with an aggregate and the binder, a process for making cores and molds, and a process for casting metals.

The binder system has a little or no odor and the exhibits a low incidence of smoke during casting. The cores produced with the binder exhibit good flexural strength, particularly good immediate strength, and are easily released from the molding equipment.

DETAILED DESCRIPTION OF THE INVENTION

Selecting an alkoxy-modified phenolic resole resin that exhibits low viscosity and favorable polarity is fundamental to the invention. According to the invention, the alkoxy-modified phenolic resin makes it possible to reduce the quantities of solvents needed, both in the phenolic resin component and in the isocyanate component. Furthermore, the use of aromatic hydrocarbons in one or both of the binder components can be dispensed with. Through the combination of the alkoxy-modified phenolic resin with oxygen-rich, polar, organic solvents, improved immediate strengths are achieved with reduced build up of smoke. The addition of fatty acid ester has a positive effect on the separation effect and on moisture resistance.

Phenolic resins are manufactured by condensation of phenols and aldehydes (Ullmann's Encyclopedia of Industrial Chemistry, Bd. A19, page 371 ff, 5th, edition, VCH Publishing House, Weinheim). In the framework of this invention, substituted phenols and mixtures thereof can also be used. All conventionally used substituted phenols are suitable. The phenolic binders are not substituted, either in both ortho-positions or in one ortho- and in the para-position, in order to enable the polymerization. The remaining ring sites can be substituted. There is no particular limitation on the choice of substituent, as long as the substituent does not negatively influence the polymerization of the phenol and the aldehyde. Examples of substituted phenols are alkyl-substituted phenols, aryl-substituted phenols, cycloalkyl-substituted phenols, alkenyl-substituted phenols, alkoxy-substituted phenols, aryloxy-substituted phenols and halogen-substituted phenols.

The above named substituents have 1 to 26, and preferably 1 to 12, carbon atoms. Examples of suitable phenols, in addition to the especially preferred unsubstituted phenols, are o-cresol, m-cresol, p-cresol, 3,5-xylol, 3,4-xylol, 3,4,5-trimethyl phenol, 3-ethylphenol, 3,5-diethylphenol, p-butylphenol, 3,5-dibutylphenol, p-amylphenol, cyclohexylphenol, p-octylphenol, 3,5-dicyclohexylphenol, p-crotylphenol, p-phenylphenol, 3,5-dimethoxyphenol, 3,4,5-trimethoxyphenol, p-ethoxyphenol, p-butoxyphenol, 3-methyl-4-methoxyphenol, and p-phenoxyphenol. Especially preferred is phenol itself. The phenols can likewise be described with the general formula:

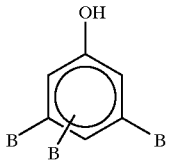

where A, B and C can be hydrogen, alkyl radicals, alkoxy radicals or halogens.

All aldehydes, which are traditionally used for the manufacture of phenolic resins, can be used within the scope of the invention. Examples of this are formaldehyde, acetaldehyde, propionaldehyde, furfuraldehyde, and benzaldehyde. Preferably, the aldehydes commonly used should have the general formula R'CHO, where R' is hydrogen or a hydrocarbon radical with 1–8 carbon atoms. Particularly preferred is formaldehyde, either in its diluted aqueous form or as paraformaldehyde.

In order to prepare the phenolic resole resins, a molar ratio aldehyde to phenol of at least 1.0 should be used. A molar ratio of aldehyde to phenol is preferred of at least 1:1.0, with at least 1:0.58 being the most preferable. In order to obtain alkoxy-modified phenolic resins, primary and secondary aliphatic alcohols are used having an OH-group containing from 1 to 10 carbon atoms. Suitable primary or secondary alcohols include, for example, methanol, ethanol, n-propanol, isopropanol, n-butanol, and hexanol. Alcohols with 1 to 8 carbon atoms are preferred, in particular, methanol and butanol.

The manufacture of alkoxy-modified phenolic resins is described in EP-B-0 177 871. They can be manufactured using either a one-step or a two-step process. With the one-step-process, the phenolic components, the aldehyde and the alcohol are brought to a reaction in the presence of suitable catalysts. With the two-step-process, an unmodified resin is first manufactured, which is subsequently treated with alcohol.

The ratio of alcohol to phenol influences the properties of the resin as well as the speed of the reaction. Preferably, the molar ratio of alcohol to phenol amounts to less than 0.25, so that less than 25 mole percent of the phenolic hydroxy groups are etherified. A molar ratio of from 0.18–0.25 is most preferred. If the molar ratio of alcohol to phenol amounts to more than 0.25, the moisture resistance decreases.

Suitable catalysts are divalent salts of Mn, Zn, Cd, Mg, Co, Ni, Fe, Pb, Ca and Ba. Zinc acetate is preferred.

Alkoxylation leads to resins with a low viscosity. The resins predominantly exhibit ortho-ortho benzyl ether bridges and furthermore, in ortho- and para-position to the phenolic OH-groups, they exhibit alkoxymethylene groups with the general formula —$(CH_2O)_nR$. In this case R is the alkyl group of the alcohol, and n is a small whole number in the range of 1 to 5.

All solvents, which are conventionally used in binder systems in the field of foundry technology, can be used. It is even possible to use aromatic hydrocarbons in large quantities as essential elements in the solution, except that those solvents are not preferred because of environmental considerations. For that reason, the use of oxygen-rich, polar, organic solvents are preferred as solvents for the phenolic resin components. The most suitable are dicarboxylic acid ester, glycol ether ester, glycol diester, glycol diether, cyclic ketone, cyclic ester (lactone) or cyclic carbonate.

Cyclic ketone and cyclic carbonate are preferred. Dicarboxylic acid ester exhibits the formula $R_1OOC—R_2—COOR_1$, where $R_1$, represents an independent alkyl group with 1–12, and preferably 1–6 carbon atoms, and $R_2$ is an alkylene group with 1–4 carbon atoms. Examples are dimethyl ester from carboxylic acids with 4 to 6 carbon atoms, which can, for example, be obtained under the name dibasic ester from DuPont. Glycol ether esters are binders with the formula $R_3—O—R_4—OOCR_5$, where $R_3$ represents an alkyl group with 1–4 carbon atoms, $R_4$ is an alkylene group with 2–4 carbon atoms, and $R_5$ is an alkyl group with 1–3 carbon atoms (for example butyl glycolacetate), with glycol etheracetate being preferred. Glycol diesters exhibit the general formula $R_5COO—R_4—OOCR_5$ where $R_4$ and $R_5$ are as defined above and the remaining $R_5$, are selected, independent of each other (for example, propyleneglycol diacetate), with glycol diacetate being preferred. Glycol diether is characterized by the formula $R_3—O—R_4—O—R_3$, where $R_3$ and $R_4$ are as defined above and the remaining $R_3$ are selected independent of each other (for example, dipropyleneglycol dimethyl ether). Cyclic ketone, cyclic ester and cyclic carbonate with 4–5 carbon atoms are likewise suitable (for example, propylene carbonate). The alkyl- and alkylene groups can be branched or unbranched.

These organic polar solvents can preferably be used either as stand-alone solvents for the phenolic resin or in combination with fatty acid esters, where the content of oxygen-rich solvents in a solvent mixture should predominate. The content of oxygen-rich solvents is preferably at least 50% by weight, more preferably at least 55% by weight of the total solvents.

Reducing the content of solvents in binder systems can have a positive effect on the development of smoke. Whereas conventional phenolic resins generally contain around 45% by weight and, sometimes, up to 55% by weight of solvents, in order to achieve an acceptable process viscosity (of up to 400 mPas), the amount of solvent in the phenolic-component can be restricted to at most 40% by weight, and preferably even 35% by weight, through the use of the low viscosity phenolic resins described herein, where the dynamic viscosity is determined by the Brookfield Head Spindle Process.

If conventional non alkoxy-modified phenolic resins are used, the viscosity with reduced quantities of solvent lies well outside the range, which is favorable for technical applications of up to around 400 mPas. In some parts, the solubility is also so bad that at room temperature phase separation can be observed. At the same time the immediate strength of the cores manufactured with this binder system is very low. Suitable binder systems exhibit an immediate strength of at least 150 $N/cm^2$ when 0.8 parts by weight each of the phenolic resin and isocyanate component are used for 100 parts by weight of an aggregate, like, for example, Quarzsand H32 (EP-A-0 771 599 or DE-A-4 327 292).

The addition of fatty acid ester to the solvent of the phenolic component leads to especially good release properties. Fatty acids are suitable, such as, for example, those with 8 to 22 carbons, which are esterified with an aliphatic alcohol. Usually fatty acids with a natural origin are used, like, for example, those from tall oil, rapeseed oil, sunflower oil, germ oil, and coconut oil. Instead of the natural oils, which are found in most mixtures of various fatty acids, single fatty acids, like palmitic fatty acid or myristic fatty acid can, of course, be used.

Aliphatic mono alcohols with 1 to 12 carbons are particularly suitable for the esterification of fatty acids. Alcohols with 1 to 10 carbon atoms are preferred, with alcohols with 4 to 10 carton atoms being especially preferred. Based on the low polarity of fatty acid esters, whose alcohol components exhibit 4 to 10 carbon atoms, it is possible to reduce the quantity of fatty acid esters, and to reduce the buildup of smoke. A line of fatty acid esters is commercially obtainable.

Surprisingly, it has been shown that fatty acid esters, whose alcohol components contain from 4 to 10 carbon atoms, are especially advantageous, since they also give binder systems excellent release properties, when their content in the solvent component of the phenolic component amounts to less than 50% by weight based upon the total amount of solvents in the phenolic resin component. As examples of fatty acid esters with longer alcohol components, are the butyl esters of oleic acids and tall oil fatty acid, as well as the mixed octyl-decylesters of tall oil fatty acids.

By using the alkoxy-modified phenolic resins described herein, aromatic hydrocarbons can be avoided as solvents for the phenolic component. This is because of the excellent polarity of the binders. Oxygen-rich organic, polar solvents, can now be used as stand-alone solvents. Through the use of the invention-based alkoxy-modified phenolic resins, the quantity of solvents required can be restricted to less than 35% by weight of the phenolic component. This is made possible by the low viscosity of the resins. The use of aromatic hydrocarbons can, moreover, be avoided. The use of invention based binder systems with at least 50% by weight of the above named oxygen-rich, polar, organic solvents as components in the solvents of the phenolic components leads, moreover, to a doubtlessly lower development of smoke, in comparison with conventional systems with a high proportion of fatty acid esters in the solvent.

The two components of the binder system include an aliphatic, cycloaliphatic or aromatic polyisocyanate, preferably with 2 to 5 isocyanate groups. Based on the desired properties, each can also include mixtures of organic isocyanates. Suitable polyisocyanates include aliphatic polyisocyanates, like, for example, hexamethylenediisocyanate, alicyclic polyisocyanates like, for example, 4,4'-dicyclohexylmethanediisocyanate, and dimethyl derivates thereof. Examples of suitable aromatic polyisocyanates are toluol-2,4-diisocyanate, toluol-2,6-diisocyanate, 1,5-napththalenediisocyanate, triphenylmethanetriisocyanate, xylylenediisocyanate and its methyl derivatives, polymethylenepolyphenyl isocyanate and chlorophenylene-2,4-diisocyanate. Preferred polyisocyanates are aromatic polyisocyanates, in particular, polymethylenepolyphenyl polyisocyanates such as diphenylmethane diisocyanate.

In general 10–500% by weight of the polyisocyanates compared to the weight of the phenolic resins are used. 20–300% by weight of the polyisocyanates is preferred. Liquid polyisocyanates can be used in undiluted form, whereas solid or viscous polyisocyanates can be dissolved in organic solvents. The solvent can consist of up to 80% by weight of the isocyanate components. As solvents for the polyisocyanate, either the above-named fatty acid esters or a mixture of fatty acid esters and up to 50% by weight of aromatic solvents can be used. Suitable aromatic solvents are naphthalene, alkyl-substituted naphthalenes, alkyl-substituted benzenes, and mixtures thereof. Especially preferred are aromatic solvents, which consist of mixtures of the above named aromatic solvents and which have a boiling point range of between 140° C. and 230° C. However, preferably no aromatic solvents are used. Preferably, the amount of polyisocyanate used results in the number of the isocyanate group being from 80 to 120% with respect to the number of the free hydroxyl group of the resin.

In addition to the already mentioned components, the binder systems can include conventional additives, like, for example, silane (U.S. Pat. No. 4,540,724), drying oils (U.S. Pat. No. 4,268,425) or "Komplexbildner" (WO 95/03903). The binder systems are offered, preferably, as two-component-systems, whereby the solution of the phenolic resin represents one component and the polyisocyanate, also in solution, if appropriate, is the other component. Both components are combined and subsequently mixed with sand or a similar aggregate, in order to produce the molding compound. The molding compound contains an effective binding quantity of up to 15% by weight of the invention-based binder system with respect to the weight of the aggregate. It is also possible to subsequently mix the components with quantities of sand or aggregates and then to join these two mixtures. Processes for obtaining a uniform mixture of components and aggregates are known to the expert. In addition, if appropriate, the mixture can contain other conventional ingredients, like iron oxide, ground flax fiber, xylem, pitch and refractory meal (powder).

In order to manufacture foundry molded pieces from sand, the aggregate should exhibit a sufficiently large particle size. In this way, the founded piece has sufficient porosity, and fugitive gasses can escape during the casting process. In general at least 80% by weight and preferably 90% by weight of the aggregate should have an average particle size of less than or equal to 290 $\mu$m. The average particle size of the aggregate should have between 100 and 300 $\mu$m.

For standard-founded pieces, sand is preferred as the aggregate material to be used, where at least 70% by weight, and preferably more than 80% by weight of the sand is silicon dioxide. Zircon, olivine, aluminosilicate sands and chromite sands are likewise suitable as aggregate materials.

The aggregate material is the main component in founded pieces. In founded pieces from sand for standard applications, the proportion of binder in general amounts to up to 15% by weight, and often between 0.5 and 7% by weight, with respect to the weight of the aggregate. Especially preferred is 0.6 to 5% by weight of binder compared to the weight of the aggregate.

Although the aggregate is primarily added dry, up to 0.1% by weight of moisture can be tolerated, with respect to the weight of the aggregate. The founded piece is cured so that it retains its exterior shape after being removed from the mold. Conventional liquid or gaseous curing systems can be used for hardening in the invention-based binder system. A slightly volatile tertiary amine, like, for example, triethylamine or dimethylethylamine, as described in U.S. Pat. No. 3,409,579, can also be passed through the founded piece.

It is further possible, to add a liquid amine to the molding compound in order to cure it. After removing the piece from the mold, further hardening takes place in the well-known way, finally resulting in the finished piece.

In a preferred implementation, silane with the general formula $(R'—O)_3—Si—R$ is added to the molding compound before the curing begins. Here, R' is a hydrocarbon radical, preferably an alkyl radical with 1–6 carbon atoms, and R is an alkyl radical, an alkoxy-substituted alkyl radical or an alkyl amine-substituted amine radical with alkyl groups, which have 1–6 carbon atoms. The addition of from 0.1 to 2% by weight with respect to the weight of the binder system and catalysts, reduces the moisture sensitivity of the system. Examples of commercially obtainable silanes are Dow Corning Z6040 and Union Carbide A-187 (γ-glycidoxypropyltrimethoxysilane), Union Carbide A-1100 (γ-aminopropyl triethoxysilane), Union Carbide A-1120 (N-β-(aminoethyl)-γ-amino-propyltrimethoxy-silane) and Union Carbide A1160 (ureidosilane).

If applicable, other additives can be used, including wetting agents and sand mixture extending additives (English Benchlife-additives), such as those in U.S. Pat. No. 4,683,252 or 4,540,724. In addition, mold release agents like fatty acids, fatty alcohols and their derivatives can be used, but as a rule, they are not necessary.

The invention is further clarified by the following examples.

EXAMPLES

If not otherwise specified, all percentages are by weight.

1. Manufacture of Phenolic Resins

The raw materials in Table I are placed in a reaction vessel fitted with reflux condenser, thermometer and agitator. The temperature is raised uniformly, under agitation, to 105–115° C., and held there until a refractive index of 1.5590 is reached. Next the condenser is switched over to distillation and the temperature is brought up to 124–126° C. over the course of an hour. At this temperature, further distillation should occur until obtaining a refractive index of 1.5940. Next a vacuum is applied, and distillation is continued under reduced pressure, until reaching a refractive index of 1.600. The yields amount to around 83% in Example 1 and around 78% in Example 2.

TABLE I (Amounts of components used to prepare comparison resin and resin within the scope of the invention)

| | Resin | |
|---|---|---|
| | 1<br>not within the scope of the invention | 2<br>within the scope of the invention |
| Phenol | 2130.7 g | 1770.6 g |
| Paraformaldehyde 91% | 865.3 g | 984.3 g |
| n-butanol | — | 279.6 g |
| Zinc acetate-dihydrate | 1.0 g | 1.5 g |

2. Manufacture of Phenolic Resin Solutions

With the phenolic resin manufactured according to the above instructions, the solutions shown in Table II are manufactured. Trade names are shown with an "H".

TABLE II (Resin components prepared with comparison resin 1 that is not within the scope of the invention)

| Resin Component | 1A | 1B | 1C | 1D |
|---|---|---|---|---|
| Phenolic resin 1 | 67.5% | 67.5% | 67.5% | 67.5% |
| DBE (H)[1] | 19.0% | 24.5% | 27.0% | 32% |
| Forbiol 102 (H)[2] | 13.0% | 7.5% | 5.0% | |
| Silane | 0.5% | 0.5% | 0.5% | 0.5% |
| Viscosity (mPas) | 2 phases | 659 | 617 | 561 |

It is noteworthy that all of these formulations for the phenolic resin component contain less than 40% by weight solvent based upon the weight of the phenolic resin component.

(Resin components prepared with resin that is within the scope of the invention)

| Resin Component | 2A | 2B | 2C | 2D | 2E | 2F | 2G | 2H |
|---|---|---|---|---|---|---|---|---|
| Phenolic resin 2 | 67.5% | 67.5% | 67.5% | 67.5% | 67.5% | 67.5% | 67.5% | 67.5% |
| DBE (H)[3] | 19.0% | 24.5% | 27.0% | 32.0% | | | | |
| BGA[4] | | | | | 32.0% | | | |
| EGD[5] | | | | | | 32.0% | | |
| DPGME[6] | | | | | | | 32.0% | |
| PPC[7] | | | | | | | | 32.0% |
| Forbiol 102 (H)[8] | 13.0% | 7.5% | 5.0% | | | | | |
| Silane | 0.5% | 0.5% | 0.5% | 0.5% | 0.5% | 0.5% | 0.5% | 0.5% |
| Viscosity (mPas) | 289 | 280 | 264 | 241 | 217 | 297 | 271 | 338 |

[1]DBE, dibasic ester, dimethyl ester mixture of dicarbonic acids with 4 to 6 carbon atoms (Dupont).
[2]Forbiol 102, butyl ester of tall oil fatty acids (Arizona Chemical).
[3]DBE, dibasic ester, dimethyl ester mixture of dicarbonic acids with 4 to 6 carbon atoms (Dupont).
[4]Butyl glycol acetate.
[5]Ethylene glycol diacetate.
[6]Dipropylene glycol dimethyl ether.
[7]Propylenecarbonate.
[8]Forbiol 102, butyl ester of tail oil fatty acids (Arizona Chemical).

Phenolic resin component 1A, separated into two phases after cooling down to room temperature, and, for that reason, will not be examined further. The viscosities of phenolic resin components 1B–1D are outside the favorable range for technical applications, which is up to around 400 mPas. On the other hand, there was no phase separation of the phenolic resin components 2A–2H prepared with the phenolic resin 2 (within the scope of the invention) and the viscosities of these phenolic resin components were acceptable.

3. Manufacture of Polyisocyanate Solutions Table III Shows the Polyisocyanate Components Used in the Binder Systems.

TABLE III (Composition of polyisocyanate components)

| | Example | | |
|---|---|---|---|
| | 3A | 3B | 3C |
| MDI[9] | 80% | 80% | 80% |
| Forbiol 102 (H) | 19.8% | | 10% |
| Forbiol 152 (H)[10] | | 19.8% | |
| Solvesso 100 (H)[11] | | | 9.8% |
| Acid chloride | 0.2% | 0.2% | 0.2% |

[9]Technical diphenyl methane diisocyanate.
[10]Forbiol 152, mixture of octyl decylester of tall oil fatty acids (Arizona Chemical).
[11]Solvesso 100, mixture of aromatic hydrocarbons (Exxon).

4.) Manufacture and Testing of the Aggregate/Binder Mixture: Test Cores were Prepared as Follows:

Into a laboratory mixer, 0.5 parts by weight of the phenolic resin solution from Table II, and 0.8 parts by weight of the polyisocyanate solution from Table III are added to 100 parts by weight of Quarzsand H 32 (Quarzwerke GmbH, Frechen), in the order given, and mixed intensively. With this mixture, test cores are manufactured according to DIN 52401, which are cured by gassing with triethylamine (10 seconds at 4 bar pressure, followed by 10 seconds purging with air).

The flexural strength of the test bodies is determined by GF-methods. In this way the flexural strength of the test bodies is tested immediately after they are manufactured (immediate strength) as well as after 1, 2, and 24 hours after manufacturing them. The results are shown in Table IV. Tests 1–3 were conducted with binders using resin components containing comparative phenolic resole resin 1 and are outside the scope of the invention. Tests 4–13 were conducted with binders using resin components containing phenolic resole resin 2 and are within the scope of this invention.

TABLE IV

| Test | 1 | 2 | 3 | 4 | 5 | 6 | 7 | 8 | 9 | 10 | 11 | 12 | 13 |
|---|---|---|---|---|---|---|---|---|---|---|---|---|---|
| RC[12] | 1B | 1C | 1D | 2A | 2B | 2C | 2D | 2E | 2F | 2G | 2H | 2D | 2D |
| PIC[13] | 3A | 3A | 3A | 3A | 3A | 3A | 3A | 3A | 3A | 3A | 3A | 3B | 3C |
| Strength ($N/cm^2$) | | | | | | | | | | | | | |
| Immediate | 105 | 120 | 140 | 205 | 235 | 225 | 205 | 225 | 200 | 230 | 180 | 190 | 210 |
| 1 hr | 380 | 355 | 390 | 555 | 575 | 565 | 580 | 560 | 555 | 530 | 430 | 580 | 500 |
| 2 hr | 400 | 405 | 400 | 555 | 575 | 565 | 580 | 560 | 570 | 590 | 440 | 585 | 530 |
| 24 hr | 555 | 540 | 530 | 590 | 630 | 610 | 590 | 570 | 570 | 600 | 550 | 590 | 570 |

[11]Solvesso 100, mixture of aromatic hydrocarbons (Exxon).
[12]Resin component used from Table II.
[13]Polyisocyanate component used from Table III.

The data in Table IV indicate the following:

Cores made with binders using conventional phenolic resins (Comparative Tests 1–3) have lower initial strengths than those binder systems that use phenolic resin components within the scope of the invention (Tests 4–13). Also, the increase in strength over time is slower.

The strengths of cores, particularly, the immediate strengths, of all the cores made with binders within the scope of the invention (Tests 4–13), are the same within the precision of the test method. There is no identifiable dependency on the content of fatty acid ester/polar solvents.

Both the fatty acid butyl ester and the fatty acid octyl/decyl ester are equally suitable as solvents for the binders within the scope of this invention (Tests 7 and 12). The use of aromatic solvents is just as feasible (Tests 7 and 13).

5. Observation of smoke developmentGF-test bars are kept in the oven 1 minute at 650° C. After removing them, the development of smoke is observed against a dark background and assessed with a rating of 10 (very strong)–1 (scarcely perceptible).

The results are shown in Table V.

TABLE V (Smoke generation tests using cores made from binders within the scope of the invention)

| Cores from Tests Described in Table IV | 4 | 5 | 6 | 7 | 8 | 9 | 10 | 11 | 12 |
|---|---|---|---|---|---|---|---|---|---|
| RC | 2A | 2B | 2C | 2D | 2E | 2F | 2G | 2H | 2D |
| PIC | 3A | 3A | 3A | 3A | 3A | 3A | 3A | 3A | 3B |
| Value | 10 | 8 | 8 | 5 | 5 | 5 | 5 | 5 | 5 |

The data in Table V indicate that the development of smoke is less if the fatty acid (Forbiol 102) is reduced in favor of oxygen-rich solvents. Casting tests with cores, which correspond to those prepared for Test 4 (containing the fatty acid ester), and those prepared with Test core 7 (no fatty acid) confirm this.

We claim:

1. A process for preparing a foundry shape by the cold-box process which comprise:

(a) forming a foundry mix comprising a major amount of aggregate and an effectively binding amount of a binding system comprising:

(i) a phenolic resole resin component, and (ii) an isocyanate component, wherein the phenolic resin component comprises (a) an alkoxy-modified phenolic resole resin component such that the mole ratio of alcohol to phenol used to prepare said alkoxy-modified phenolic resole resin is less than 0.25:1, and (b) at least one oxyen-rich, polar organic solvent component, wherein the solvent portion of the phenolic resin component of the binder system amounts to no more than 40% by weight based upon the weight of the phenolic resin component and the amount of oxyen-rich polar organic solvent is at least 50 weight percent based on the total weight of the solvent in the phenolic resin component;

and wherein either the phenolic resin component, isocyanate component, or both of said components contain a fatty acid ester having from 1 to 12 carbon atom in the alcohol chain of the fatty acid ester;

(b) forming a foundry shape by introducing the foundry mix obtained from step (a) into a pattern;

(c) contacting the foundry mix with a volatile tertiary amine catalyst;and (d) removing the foundry shape of step (c) from the pattern.

2. The process of claim 1 wherein the oxyen-rich polar, organic solvent is selected from the group consisting of glycol ether esters, glycol diesters, glycol dithers, cyclic ketones, cyclic esters, cyclic carbonate, and mixtures thereof.

3. The process of claim 2 wherein the fatty acid ester is part of the phenolic resin component and is derived from an alcohol having from 4 to 10 carbon atoms.

4. The process of claim 3 wherein the fatty acid ester is the butyl ester of tall oil fatty acids.

5. The process of claim 4 wherein the amount of said binder in said binder in said foundry mix is about 0.6 percent to about 5.0 percent based upon the weight of the aggregate.

* * * * *